US008708171B2

(12) United States Patent
Schmidt et al.

(10) Patent No.: US 8,708,171 B2
(45) Date of Patent: Apr. 29, 2014

(54) BOOM FOR RECEIVING LOADS ON THE END THEREOF, BOOM ASSEMBLY WITH AT LEAST TWO SUCH BOOMS AND METHOD OF MANUFACTURING SUCH A BOOM

(75) Inventors: Peter Schmidt, Zweibrücken (DE); Frank Schnittker, Zweibrücken (DE)

(73) Assignee: Terex Demag GmbH (DE)

( * ) Notice: Subject to any disclaimer, the term of this patent is extended or adjusted under 35 U.S.C. 154(b) by 471 days.

(21) Appl. No.: 12/877,211

(22) Filed: Sep. 8, 2010

(65) Prior Publication Data

US 2011/0068076 A1 Mar. 24, 2011

Related U.S. Application Data

(63) Continuation of application No. PCT/DE2009/000167, filed on Feb. 6, 2009.

(30) Foreign Application Priority Data

Mar. 8, 2008 (DE) ..... 10 2008 012 203

(51) Int. Cl.
*B66C 13/16* (2006.01)

(52) U.S. Cl.
USPC ..... 212/278; 212/270; 212/347

(58) Field of Classification Search
USPC ..... 212/278, 347, 270, 271
See application file for complete search history.

(56) References Cited

U.S. PATENT DOCUMENTS

| | | | | |
|---|---|---|---|---|
| 5,694,734 | A * | 12/1997 | Cercone et al. | 52/745.17 |
| 6,755,212 | B1 * | 6/2004 | Bissen et al. | 137/615 |
| 6,786,233 | B1 * | 9/2004 | Willner et al. | 137/615 |
| 2004/0055385 | A1 * | 3/2004 | Kolb et al. | 73/715 |
| 2005/0011560 | A1 * | 1/2005 | Anderson et al. | 137/615 |
| 2005/0011604 | A1 * | 1/2005 | Anderson et al. | 156/173 |
| 2006/0257604 | A1 * | 11/2006 | Anderson et al. | 428/36.2 |

FOREIGN PATENT DOCUMENTS

EP 0968955 A2 1/2000

* cited by examiner

*Primary Examiner* — Emmanuel M Marcelo
(74) *Attorney, Agent, or Firm* — Cantor Colburn LLP

(57) ABSTRACT

A boom (1) is used for receiving loads on the end thereof. The boom (1) has a metal boom hollow profile (2) extending along a boom longitudinal axis (3), and also a reinforcing layer (7) made of a fiber-plastic composite, connected to the boom hollow profile (2) at least in sections. At least one sensor element (12) is arranged in the region of the reinforcing layer (7). The sensor element (12) is used to detect strains in the boom (1).

24 Claims, 5 Drawing Sheets

Figure 1:
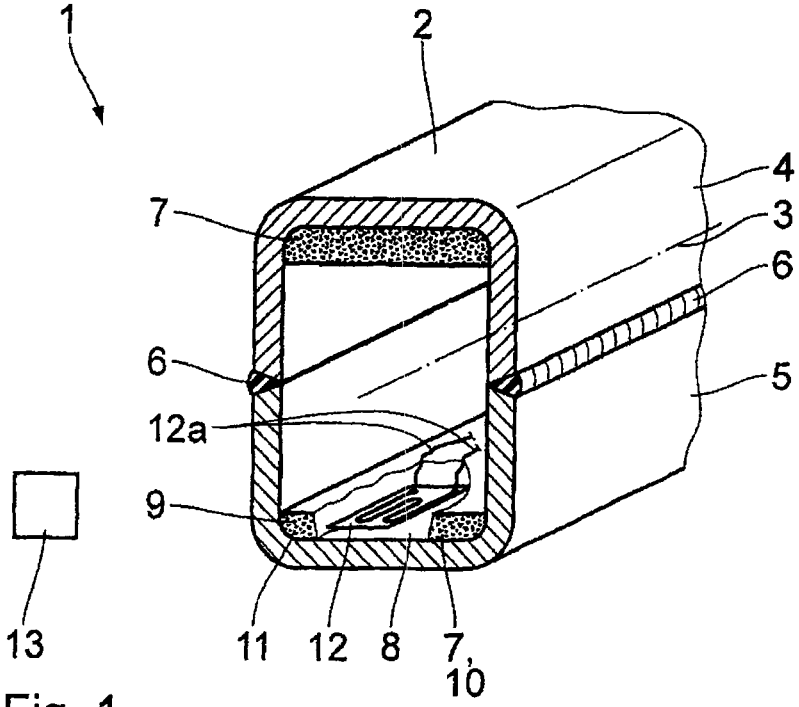

BOOM FOR RECEIVING LOADS ON THE END THEREOF, BOOM ASSEMBLY WITH AT LEAST TWO SUCH BOOMS AND METHOD OF MANUFACTURING SUCH A BOOM

CROSS REFERENCE TO RELATED APPLICATION

This application is a continuation of PCT/DE2009/000167 filed Feb. 6, 2009. This application also claims the benefit of German Patent Application No. 10 2008 012 203.9 filed Mar. 8, 2008, the entire contents of which are incorporated herein by reference thereto.

FIELD OF THE INVENTION

The invention relates to a boom for receiving loads on the end thereof with a metal boom hollow profile extending along a boom longitudinal axis and having a reinforcing layer made of a fiber-plastic composite connected to the boom hollow profile that is present at least in sections. The invention also relates to a boom assembly with at least two such booms and to a method for manufacturing such a boom. Finally, the invention relates to a construction machine, in particular to a crane, with such a boom and/or with such a boom assembly.

BACKGROUND

Light-weight boom parts are an important prerequisite for meeting the requirements for mobile working machines, such as work platforms, cranes, concrete pumps etc. with regard to large load-bearing capacity, large boom length and long reaches. By means of a lightweight construction, these performance data can be improved in comparison to conventional designs, without increasing the total weight of the machine or unfavorably shifting the center of gravity. For example, in the case of mobile cranes, mobile work platforms and mobile concrete pumps, the negative effects of the weight of the boom on the vehicle size and weight, the support base, the number of axles and the needed counterweights can be kept small.

Monolithic designs using fiber-plastic composites (FKVs) like those used e.g. in aeronautics and space travel, are one possibility for implementing this kind of lightweight construction. They are indeed very light, but for financial and safety considerations they are not suitable for the construction of mobile working machines. The production of box girders in a monolithic composite fiber design is very cost-intensive, owing to the complicated fiber structure for force transmission or bearings. In addition, monolithic FKVs are sensitive to impacts, so that they are not suitable for use on a construction site, in building machines such as cranes.

One alternative to a pure FKV design is to use a hybrid construction which combines metallic materials with FKVs. A boom using this hybrid design is known from EP 0 968 955 A2.

The present invention is directed to improvements to a boom of the kind specified above so that the reinforcing layer can be tailored precisely to the particular application, wherein the job-site utility in particular, and thus also the safety are to be increased.

SUMMARY

The sensor element according to the invention is used, for example, for detecting a bending moment. For example, in a probing phase of the boom and/or upon the initial usage of a hybrid boom designed according to this invention with a metallic boom hollow profile and a fiber-plastic composite reinforcing layer, it can be determined whether damage occurs in the structure of the boom hollow profile. The reinforcing layer can be dimensioned according to the load forces measured by the sensor element. Also, age-related or overload-related deformations in the structure of the boom can be recognized reliably by means of the sensor element. Cost-intensive inspection steps for fiber-plastic composites, for example, thermography or ultrasound inspections, can be eliminated. In the case of the hybrid design according to the invention, that is, when using a metallic component and a fiber-plastic component, the specific properties of the fibers in the reinforcing layer can be utilized for improved flexural rigidity and for improving the flexural resistance of the metallic boom hollow profile. In contrast to a purely fiber-plastic composite component without metallic component, in the boom according to the invention preponderance of the shear forces and of the force transmission can be handled by the metallic boom hollow profile, for example. The boom can also have multiple sensor elements. By interconnecting multiple sensor elements according to the invention, for example, flexural moments and a normal force can be detected in the boom. If the sensor elements are positioned at suitable sites, a change in the distribution of elongations between the metallic boom hollow profile on the one hand, and the FKV on the other hand, can be detected. Any such change in distribution is an indication of damage that has occurred, for example due to a delamination or due to a fiber break.

A strain sensor on the one hand is a reliable measuring instrument, and on the other hand it is a low-cost sensor element, especially when designed as a strain gauge.

An external control unit can process additional information, such as hydraulic pressures for operating a construction machine in which the boom is used, which cause an inclination of the boom from the vertical or a tensile force in any existing bracing elements. The information obtained from the sensor elements according to the invention supplement this additional information processed by the external control unit. This will enable the external control unit reliably to detect and to prevent unsafe states of the construction machine containing the boom, by switching off a hoisting unit or a rocker system, for example. As external control unit, a control unit like those regularly employed on modern mobile cranes can be used in particular.

An internal reinforcing layer, thus a reinforcing layer arranged in the boom hollow profile is shielded against external influences. This, too, is an important advantage compared to a design like that known from EP 0 968 955 A2, where the impact-sensitive FKV is positioned on the outside. A boom with this kind of internal reinforcing layer made of a fiber-plastic composite in a metallic boom hollow profile can also be used even without a sensor element for detecting load forces, since such a boom has advantages even without the sensor element, over the prior art known, for example, from EP 0 968 955 A2. Also, the reinforcing layer is protected against weather factors. Overall, the job-site utility and thus the safety of the boom are increased. The boom hollow profile and/or the profiled sections thereof can then also be used as tools for production of the hybrid boom. Investment costs for a winch or for a corresponding tool are eliminated. Attached accessories located externally on the boom are not impeded by any potentially disruptive fiber-plastic composite located there. Attachments can then be welded in particular to the boom hollow profile.

Design of the fiber-plastic composite according to one aspect produces stable reinforcement with low weight.

In particular, a fiber arrangement according to another aspect increases the bending rigidity of the boom.

Specifically some of the fibers in the reinforcing layer can be arranged at a slant or diagonally with respect to the boom longitudinal axis. In particular, there can even be two groups of fibers that intersect each other. Fibers arranged in this manner support the transfer of shear forces from torsional and transverse loads and increase the bending rigidity of cross sectional portions of the boom.

An electrically isolating intermediate layer protects the metallic boom hollow profile against corrosion, in particular when the FKV reinforcing layer has carbon fibers. In this case a fiberglass layer is preferred in particular.

Profiled sections simplify the production of the boom according to the invention.

A U-profiled shape of the profiled sections will allow the arrangement of the reinforcing layers in which they are spatially well separated from connecting sections between the profiled sections forming the boom hollow profile. The profiled sections can then be welded together, for example, by the leg of the U, with no danger of damaging the reinforcing layer positioned at the bottom of the U, for example. As an alternative to the U-shape, the profiled sections can also be flat, as an L-profile or with multiple kinks in the cross section. A cross sectional design of the boom with multiple kinked profiled sections will produce a boom with a hexagonal or octagonal cross section.

A group of sensor elements according to yet another aspect will permit a temperature-compensated measurement of occurring load forces, for example, of occurring flexural moments.

The arrangement of two sensor elements according to yet another aspect makes it possible in particular to detect any undesirable delamination of the reinforcing layer from the boom hollow profile.

yet another aspect describes a boom with an internal reinforcing layer, but not necessarily with a sensor element like that already described herein.

The advantages of a boom assembly according to yet another aspect correspond to those already described above in connection with the boom according to the invention. Two such booms can engage within each other in a telescoping manner, for example, and can be connected together. This will assure that the two booms are driven with respect to each other so that any damage to a reinforcing layer of the one boom by the neighboring moving boom hollow profile of the other boom will be prevented. Booms according to the invention also can be joined other than telescopically into a boom assembly by means of detachable connections such as bolts or screws, or can form a collapsible boom assembly by means of articulated joints.

Another task of the invention is to specify a low-cost manufacturing method for the boom according to the invention.

This problem is solved according to the invention by a method according to yet another aspect.

A manufacturing method according to one aspect uses in particular the advantages of the subdividing the boom hollow profile into profiled sections. Whenever a complete boom hollow profile is created as starting element for connection to the reinforcing layer, then the reinforcing layer can also be inserted into the hollow profile, or if provided the reinforcing layer is located outside of the hollow profile, it can be attached to it. The sensor element can be introduced together with the reinforcing layer into the boom or can even be produced together with the boom hollow profile. Alternatively, it is possible to attach the sensor element before the application of the reinforcing layer or only thereafter. Under certain circumstances, the attachment of a sensor element can also be omitted, especially when the reinforcing layer is arranged within the hollow cavity of the boom hollow profile.

Application of the reinforcing layer according to another aspect is suitable for automated production of the boom. The fiber-plastic composite is produced by application of the reinforcing layer consisting of the fiber layer and the synthetic polymeric resin. After placement of the fiber layer, the synthetic resin/hardener mixture can be injected under vacuum. No pre-produced fiber-plastic composite needs to be prepared in advance. The reinforcing layer in this manufacturing method can be readily adapted to the boom hollow profile and/or to the profiled section. The boom hollow profile and/or the profiled section is then used simultaneously as a tool in the production of the hybrid boom.

Orientation of the fibers according to yet another aspect can result in an improvement in the properties of the boom with respect to a given load; for example it can increase the flexural rigidity.

The intermediate layer according to yet another aspect can afford protection against contact corrosion of the metallic hollow profile.

A tear-off layer that can be applied to the fiber layer before injection of the synthetic polymer resin/hardener mixture makes it possible easily to separate from the reinforcing layer any other layers present after manufacture of the boom as a result of the manufacturing process, but which are not a constituent of the end product.

A distribution layer that can be applied onto the fiber layer before the injection and by means of which the injected synthetic resin is initially distributed transverse to the boom longitudinal axis improves the embedding of the fiber layer in the synthetic resin when carrying out the manufacturing process in which a synthetic polymeric resin is injected into the fiber layer.

In a manufacturing process according to yet another aspect, a premanufactured reinforcing layer of a fiber-plastic composite can be used. In particular when geometrically simple boom hollow profiles are used, this can ultimately lead to lower production costs. With this manufacturing method the sensor elements can first be integrated into the FKV reinforcement.

Cementing according to yet another aspect results in more reliable joining of the reinforcing layer to the boom hollow profile and/or to the profiled section.

The use of a pressure element according to yet another aspect makes an elegant use of the geometry of the boom hollow profile for the attachment of two reinforcing layers simultaneously.

A pressure element arranged between the reinforcing layers in the interior of the boom hollow profile along the boom longitudinal axis can be helpful in the production of the boom in order to simplify the connection of the reinforcing layers to the boom hollow profile in the production of the boom. The pressure element can be a hose that can be pressurized.

A fluid filling according to yet another aspect allows a defined pressure application to the pressure element when cementing the reinforcing layers. Also tempering—for hardening the adhesive for example—is possible by means of such a pressure element by suitable temperature control of the fluid.

BRIEF DESCRIPTIONS OF THE DRAWINGS

Figure 2:
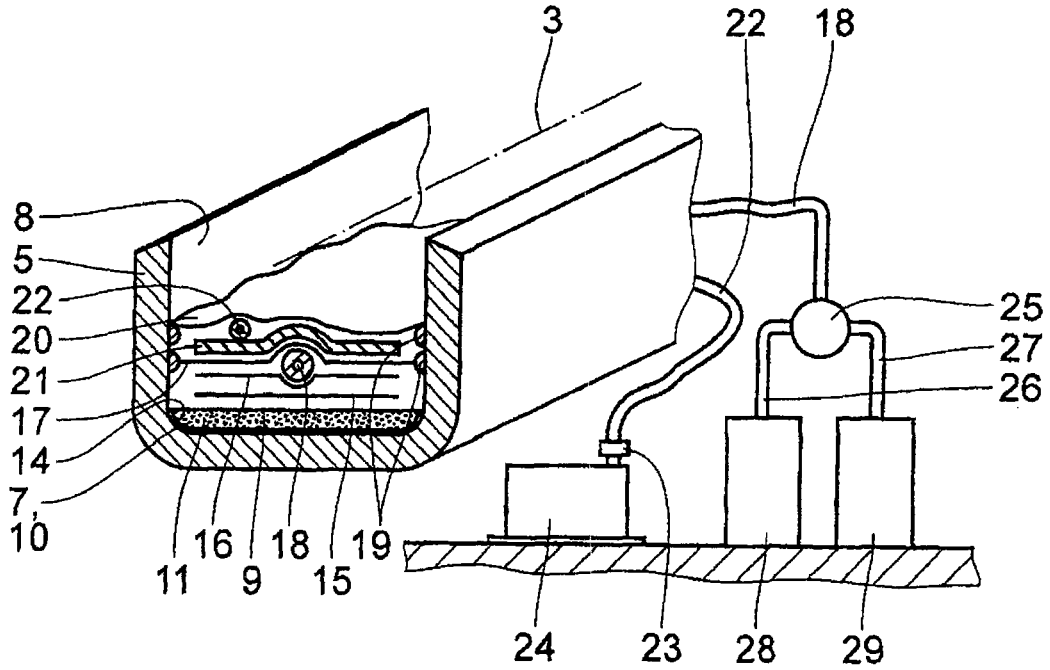
Figure 3:
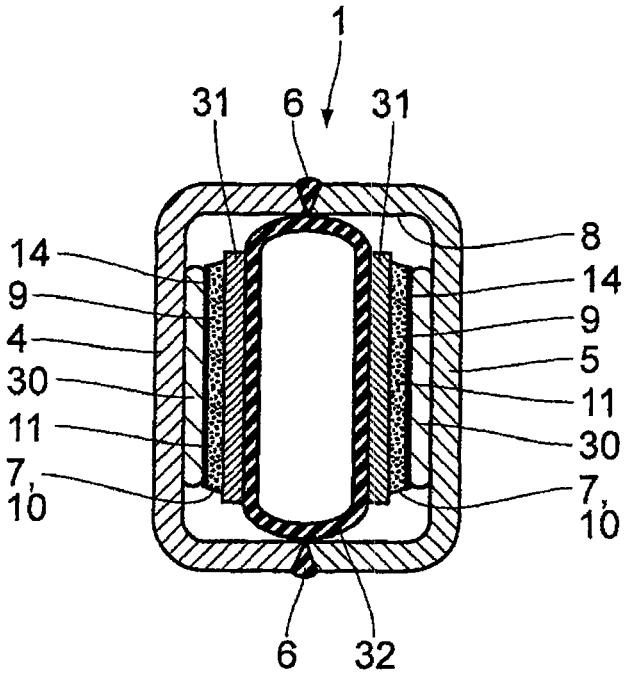
Figure 4:
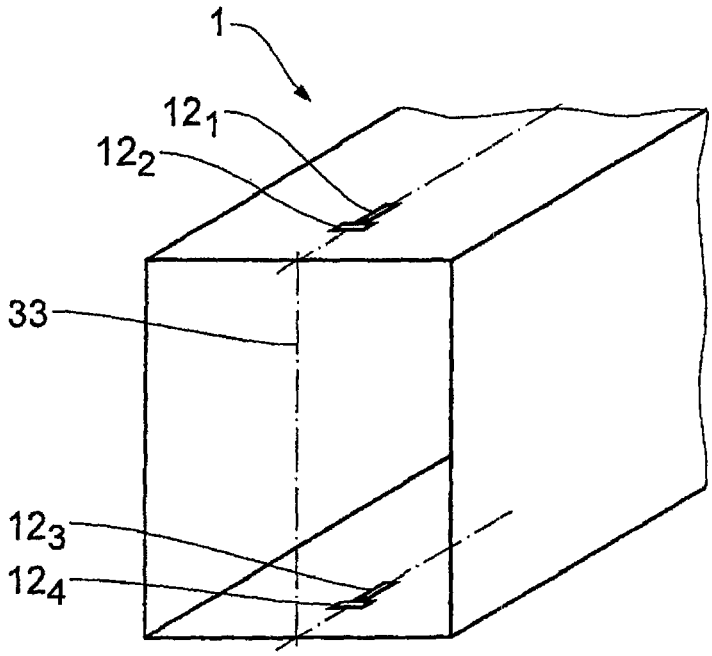
Figure 5:
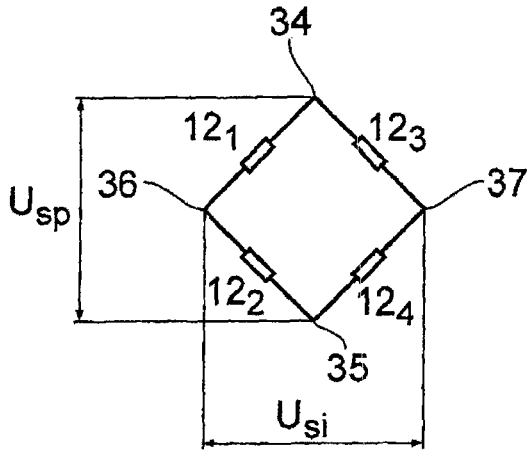
Figure 6:
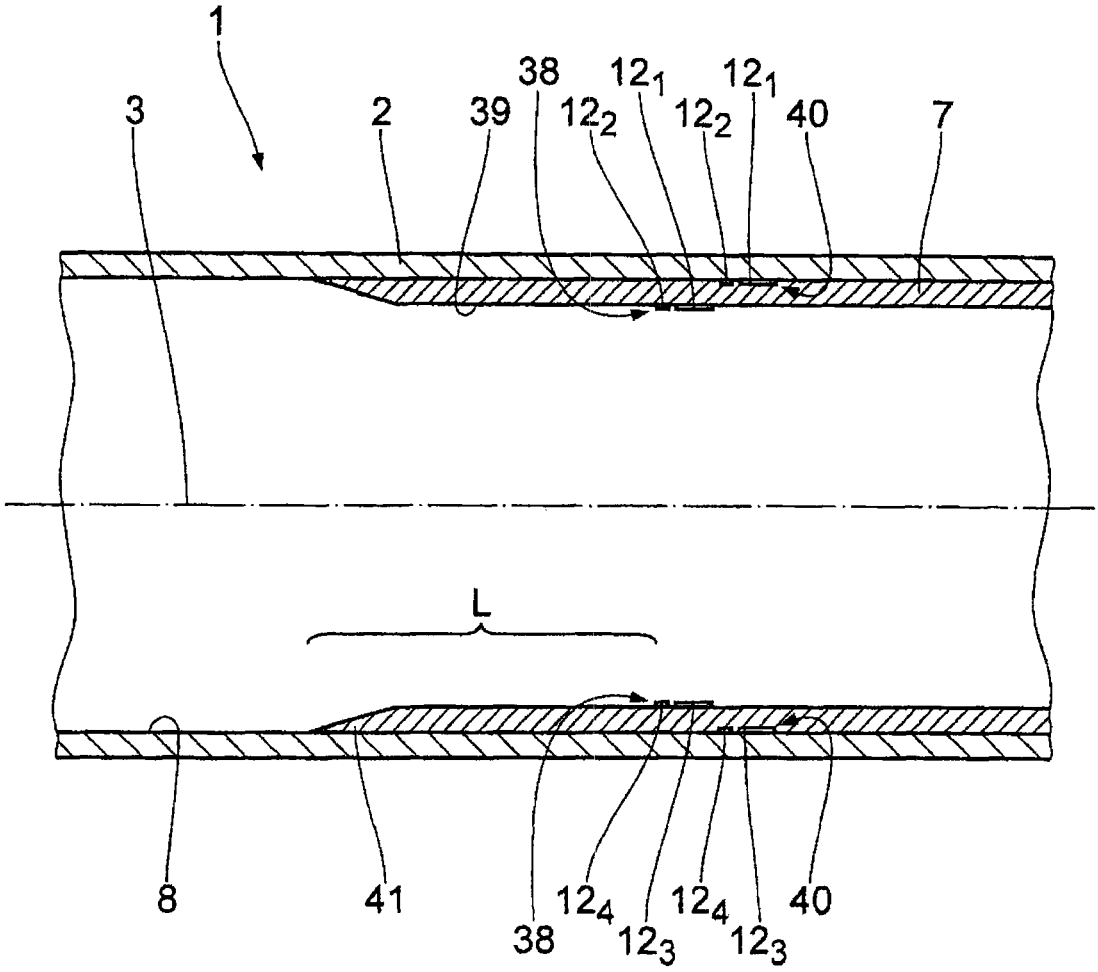
Figure 7:
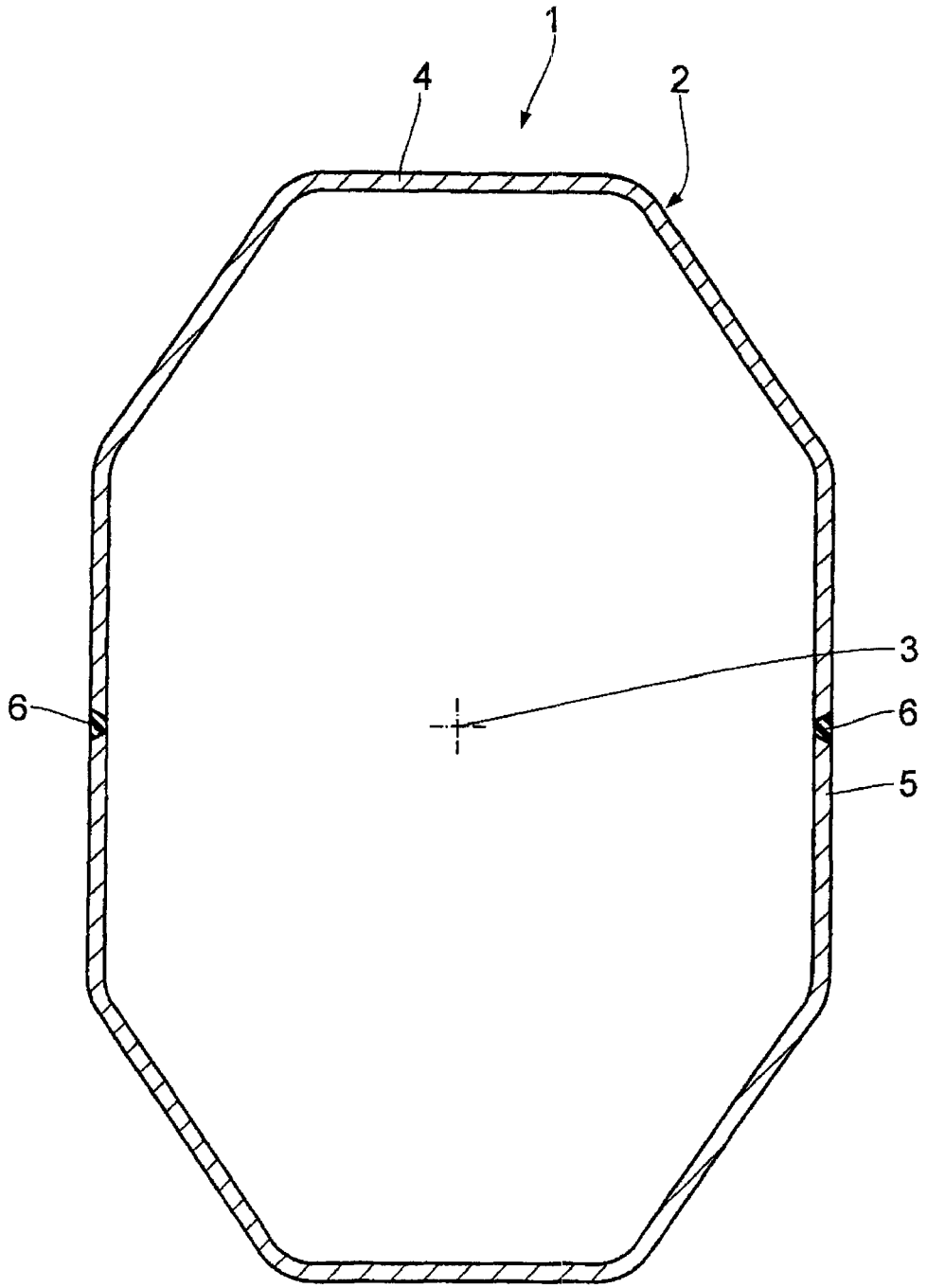

Sample embodiments are described in greater detail below with reference to the figures. The figures show:

FIG. 1: a cross section through a boom for receiving loads on the end thereof, designed as a box girder, seen in perspective cross section;

FIG. 2: a profiled section of the boom, called a profiled segment, likewise in perspective illustration, during the connecting of a reinforcing layer to the profiled section in the course of production of the boom;

FIG. 3: a cross section through another embodiment of a boom, likewise designed as a box girder, during the connecting of a reinforcing layer to a boom hollow profile in the course of another variant of a method for production of the boom;

FIG. 4: a schematic illustration similar to FIG. 1 showing the arrangement of four sensor elements on the boom according to FIG. 1 for temperature-compensated measurement of the bending moment during a bending of the boom in a bending plane running vertically in FIG. 4;

FIG. 5: interconnection of the four sensor elements according to FIG. 4;

FIG. 6: another embodiment of a boom shown in longitudinal cross section, wherein two groups of sensor elements are interconnected according to FIG. 5 arranged in groups of four sensor elements according to FIG. 4; and FIG. 7: a schematic cross section of a boom hollow profile in another embodiment of the boom.

DESCRIPTION OF THE EMBODIMENTS

The following description is merely exemplary in nature and is not intended to limit the present disclosure, its application or uses. It should be understood that throughout the drawings, corresponding reference numerals indicate like or corresponding parts and features.

A boom 1 illustrated in cross section and in perspective in FIG. 1 is used for receiving loads on the end thereof. For example, the boom 1 can be a constituent of a work platform, of a crane or of a concrete pump. The boom 1 has a boom hollow profile 2 designed as a box girder with a longitudinal axis 3 indicated by dashed lines in FIG. 1. The boom hollow profile 2 is made of metal. The boom hollow profile 2 is composed of two profiled sections 4, 5 each with a U-shaped cross section. The two profiled sections 4, 5 are joined together by means of weld seams 6 that run along the boom longitudinal axis 3.

One reinforcing layer 7 is applied to the bottom of each of the profiled sections 4, 5. The two reinforcing layers 7 have the same structure, so that it is sufficient to describe the reinforcing layer 7 applied to profiled section 5 that is illustrated on the bottom of FIG. 1. The reinforcing layer 7 is arranged as a reinforcing lining in the hollow cavity of boom hollow profile 2, and thus rests against an inner wall 8 of the profiled section 5. The reinforcing layer 7 is made of a fiber-plastic composite. In this case we are dealing in particular with a carbon fiber-synthetic resin composite. Carbon fibers 9 of a fiber layer 10 of the reinforcing layer 7 are bonded together by a synthetic polymeric resin matrix 11 and joined to the inner wall 8.

The carbon fibers 9 of the reinforcing layer 7 can have different orientations. They can be arranged predominantly with a component running parallel to the longitudinal axis 3 of the boom 1. They can also be arranged predominantly diagonally with respect to the longitudinal axis 3.

In particular, all fibers 9 can be arranged diagonally with respect to the longitudinal axis 3. There can also be two groups of fibers 9 that intersect one another. These two fiber groups can belong to different single superimposed layers of fiber of the fiber layer 10.

In the region of the reinforcing layer 7 there is a sensor element 12. Signal- and/or supply lines 12*a* that are connected to the sensor element 12 are run for a distance along the boom hollow profile 2 and then are conducted to the outside thereof. The sensor element 12 is used for detecting loads acting on the boom 1. The sensor element 12 is designed as a strain sensor and in particular as a strain gauge. The signal from the sensor element 12 is connected to an external control unit 13 by means of a signal connection (not illustrated). This signal connection processes and/or receives the measured values recorded by the sensor element 12, and also additional information detected by additional sensors about the state of a working or construction machine of which the boom 1 is a part. This additional information can be hydraulic pressures, for example, an inclination of the boom 1 with respect to the vertical, or a tensile force in a bracing element or working machine (not illustrated).

The sensor element 12 can be embedded in the reinforcing layer 7. Alternatively, it is possible to arrange the sensor element 12 on the side of the reinforcing layer 7 facing the hollow cavity of the boom hollow profile 2. Finally, it is possible to arrange the sensor element 12 between the reinforcing layer 7 and the profiled section 5.

In practice, the boom 1 has multiple sensor elements 12 whose signals are all connected to the control device 13.

The sensor element 12 is used in particular for detecting a bending moment and also for detecting the presence of any damage to the boom 1.

Multiple sensor elements 12 can be interconnected into a common measuring apparatus and be integrated into a Wheatstone bridge, for example. This interconnection can be configured in particular so that the influence of an irregular heating of the boom 1 on the measured result from the sensor elements 12 will be compensated.

An electrically isolating intermediate layer 14, FIG. 2, is arranged between the reinforcing layer 7 and the interior wall 8; this layer is designed as a fiberglass layer.

A method for production of the boom 1 is described below based on FIG. 2. In this regard we are dealing with a vacuum-injection method in which the profiled sections of the boom hollow profile 2 perform the function of a tool. The profiled section 5 of boom 1 is seen in greater detail in FIG. 2 than in FIG. 1.

The fiber layer 10 is initially set onto intermediate layer 14 with non-matrix-bonded fibers 9. During or after placement of the fiber layer 10, the fibers 9 of the fiber layer 10 are oriented, that is, aligned to the longitudinal axis 3, with an orientation of fibers 9 being effected in accordance with the preceding description. A tear-off layer 15 is placed onto the oriented fiber layer 10. Then in turn, a distributor layer 16 in the form of a distribution web is placed upon the tear-off layer 15. A resin line 18 running along the longitudinal axis 3 is positioned between distribution web 16 and a resin-impermeable—but air permeable—film 17 placed thereon. The film 17 is sealed against profiled section 5 by means of sealing strips 19 running along the longitudinal axis 3 and positioned against the interior wall 8 of the profiled section 5. Above the film 17 there is another air-impermeable film 20 arranged between the legs of the profiled section 5 that is sealed from the interior wall 8 of the profiled section 5 by another pair of sealing strips 19. A layer of bonded fiber fabric 21 is arranged between the two films 17, 20 positioned one upon the other. An air line 22 is arranged between the layer of bonded fiber fabric 21 and the air-impermeable film 20 as illustrated in FIG. 2; this air line 22 likewise runs parallel to the longitudinal axis 3. The air line 22 is connected via a connecting element 23 to a vacuum pump 24.

The resin line 18 branches via a mixer element 25 into a resin line section 26 and a hardener line section 27. The resin line section 26 has a fluid connection to the resin reservoir 28 and the hardener line section 27 has a fluid connection to the hardener reservoir 29. The resin and hardener are brought together in the mixer element 25 in a defined mixing ratio and a chemically reactive resin/hardener mixture is produced.

By means of the configuration shown in FIG. 2, the reinforcing layer 7 can be laminated directly onto the profiled section 5, and subsequently the prepared profiled sections 4, 5 are bonded together accordingly with the reinforcing layers 7. When laminating the reinforcing layer 7, the profiled sections 4, 5 are used simultaneously as molding tools for the reinforcing layer 7.

The intermediate layer 14 is placed onto the base of the profiled section 5 after a surface treatment of the profiled section 5, for example after degreasing and sandblasting the profiled section 5. Next, the fibers 9 are placed as a dry fiber layer 10 onto the intermediate layer 14 and oriented thereon. The aligned fibers 9 are designed in particular as endless fibers. This also applies even when the boom hollow profile 2 has a variable cross section along the longitudinal axis 3. As a rule, only a smaller portion of the carbon fibers 9 will have an orientation parallel to the longitudinal axis 3.

For production of the reinforcing layer 7, synthetic polymeric resin mixed with a hardener is injected through the resin line 18 into the fiber layer 10. The synthetic resin cements the fibers 9 to the base of the profiled section 5. The synthetic resin emerging from distribution openings arranged along the resin line 18 is thus distributed over the distribution layer 16 transverse to the longitudinal axis 3 of profiled section 5, penetrates through the tear-off layer 15 and into the fiber layer 10. The resin-impermeable film 17 ensures that no unwanted resin/hardener mixture can penetrate into other regions outside of the fiber layer 10.

The space between the films 17, 20 containing the bonded fiber fabric 21 can be evacuated by means of the air line 22. This evacuation prevents air inclusions that could lead to potential delamination and thus to material inconsistency. A pressure difference produced by the evacuation drives the resin/hardener mixture into the gaps between the fibers 9 in the fiber layer 10.

The resin/hardener mixture in the fiber layer 10 can be hardened at room temperature or at elevated temperatures, e.g. at 80° C. Hardening under heat can be carried out in a heating oven or by placement on a heating mat.

After hardening, the distribution mat 16 and the two films 17, 20 with the intermediate bonded fiber fabric 21 and the two lines 18, 22 can be removed by tearing off using the tear-off layer 15.

The profiled sections 4, 5 prepared in this manner with reinforcing layers 7 are then welded, producing the weld seams 6.

The sensor elements 12 in the boom 1 can be installed either directly during the manufacture of the reinforcing layers 7 or when connecting the reinforcing layers 7 and the profiled sections 4, 5, or only after production of the hybrid structure composed of profiled sections 4 and 5 and the reinforcing layers 7.

In an exemplary embodiment, FIG. 3 shows a cross section of another variant of a boom 1 that can be produced using a variant of a manufacturing method disclosed. Components and procedural details which correspond to those explained above, with reference to FIGS. 1 and 2, are assigned the same reference numbers and are not again discussed in detail. In this manufacturing variant, first the profiled sections 4, 5 are produced separately and then joined to the boom hollow profile 2 via the weld seams 6. The reinforcing layers 7 are also produced in a separate process step. The fibers 9 of the fiber layers 10 of the reinforcing layers 7 are thus oriented so that after joining to the profiled sections 4, 5, they have an orientation that corresponds to that explained above in connection with FIGS. 1 and 2.

Next, the reinforcing layers 7 are coated on one side with an adhesive 30; for example an adhesive based on epoxy resin. The reinforcing layers 7 are then inserted into the boom hollow profile 2 so that the adhesive sides of the reinforcing layers 7 are each facing the interior walls 8 of the profiled sections 4, 5. After placement of the reinforcing layers 7, two pressure plates 31 and also one pressure element 32 in the form of a fluid-filled hose are inserted into the boom hollow profile 2. The pressure element 32 runs along the longitudinal axis 3 of the boom 1. The two pressure plates 31 are each arranged between the pressure element 32 and one of the two reinforcing layers 7.

The pressure element 32 in particular is a hollow, pressurized cushion made of a rubbery elastic material. After placement of the pressure plate 31 and the pressure element 32, the latter is filled with a pressurized fluid, that is, a gaseous or liquid medium, so that a pressure ("p") is produced in the pressure element 32. Due to this pressure, the reinforcing layers 7 are pressed via the pressure plates 31 against the interior wall 8 and thus against the two adhesive layers 30. This continues until the adhesive 30 is hardened. This hardening in turn can be carried out at room temperature or at elevated temperature. For hardening the adhesive 30, the boom 1 is placed into a heating oven, or an appropriately preheated liquid such as water or oil is fed into the pressure element 32.

After hardening, the pressure element 32 and the two pressure plates 31 are removed from the boom hollow profile 2.

The reinforcing layers 7 have already been prepared with the sensor elements 12. Sensor elements 12 can be arranged relative to the reinforcing layers 7 as was already explained above in connection with the embodiment according to FIGS. 1 and 2. Alternatively, it is also possible to embed the sensor elements 12 in the adhesive layer 30, following assembly or construction.

FIG. 4 shows a schematic, perspective view of a boom 1 similar to FIG. 1, with four sensor elements denoted overall as $\mathbf{12}_1$, $\mathbf{12}_2$, $\mathbf{12}_3$ and $\mathbf{12}_4$, which are accommodated as a kind of sensor element 12 or as sensor elements 12 in the embodiments described above. Sensor elements $\mathbf{12}_1$ to $\mathbf{12}_4$ are used for temperature-compensated measurement of a bending moment of boom 1 in a vertically positioned bending plane 33 in the perspective illustration as per FIG. 4. Sensor elements $\mathbf{12}_1$ to $\mathbf{12}_4$ are designed as strain gauges. Sensor elements $\mathbf{12}_1$ and $\mathbf{12}_3$ are arranged at the same height on opposing profile walls of the boom hollow profile 2. Sensor elements $\mathbf{12}_2$ and $\mathbf{12}_4$ are likewise arranged at the same height on opposing profile walls of boom hollow profile 2. Sensor element $\mathbf{12}_1$ is adjacent to sensor element $\mathbf{12}_2$. Sensor element $\mathbf{12}_3$ is adjacent to sensor element $\mathbf{12}_4$.

Sensor elements $\mathbf{12}_1$ and $\mathbf{12}_3$ are aligned in the longitudinal direction of boom 1. Sensor elements $\mathbf{12}_2$ and $\mathbf{12}_4$ are aligned transverse to the longitudinal direction and perpendicular to the bending plane 33.

During bending of the boom 1 in the bending plane 33, sensor elements $\mathbf{12}_1$ and $\mathbf{12}_3$ are stretched or compressed and thus provide a signal value for measurement of the bending torque. Sensor elements $\mathbf{12}_2$ and $\mathbf{12}_4$ are used to measure the bending moment in bending plane 33 for temperature compensation and to compensate for nonuniform heating of the boom 1.

FIG. 5 shows the interconnection of sensor elements $\mathbf{12}_1$ to $\mathbf{12}_4$. The sensor elements are nested together as a kind of measurement bridge, and a supply voltage $U_{sp}$ can be injected at injection points 34, 35 and a signal voltage $U_{si}$ can be picked off at tapping points 36, 37. Sensor element $\mathbf{12}_1$ is arranged between injection point 34 and the tapping point 36. Sensor element $\mathbf{12}_2$ is arranged between injection point 35 and tapping point 36. Sensor element $\mathbf{12}_3$ is arranged between injection point 34 and tapping point 37. Sensor element $\mathbf{12}_4$ is arranged between injection point 35 and tapping point 37.

FIG. 6 shows another embodiment of a boom 1. Components corresponding to those already explained above with reference to FIGS. 1 to 5 are assigned the same reference numbers and will not be explained again in detail. In a longitudinal cross section through another embodiment of a boom 1 according to FIG. 6, the reinforcing layer 7 is arranged as a reinforcing lining in one section of the boom hollow profile 2. A first group of sensor elements 38 with four sensor elements $\mathbf{12}_1$ to $\mathbf{12}_4$, in the way of sensor element $\mathbf{12}_1$ to $\mathbf{12}_4$ according to FIGS. 4 and 5, is arranged on an interior wall 39 of the reinforcing layer 7. A second group of sensor elements 40, likewise composed of four sensor elements $\mathbf{12}_1$ to $\mathbf{12}_4$ corresponding to sensor elements $\mathbf{12}_1$ to $\mathbf{12}_4$ of FIGS. 4 and 5, is arranged between the reinforcing layer 7 and the boom hollow profile 2.

With the two groups of sensor elements 38, 40, it is possible to detect any undesirable delamination of reinforcing layer 7 in a region L between a wedge-shaped end section 41 of the reinforcing layer 7 running out toward the interior wall 8, and the sensor elements $\mathbf{12}_1$ to $\mathbf{12}_4$ of the sensor element group 38, which is closer to the wedge-shaped end section 41 than the sensor element group 40. As long as a connection between the boom hollow profile 2 and the reinforcing layer 7 is intact in the region L, then the two groups of sensor elements 38 and 40 provide very similar measurement signals $U_{si}$ at the same supply voltage $U_{sp}$. The two groups of sensor elements 38, 40, thus the two measurement bridges formed by these sensors, are then redundant.

As soon as a delamination of the reinforcing layer 7 from the boom hollow profile 2 has occurred in region L, the stretching or compression of sensor elements $\mathbf{12}_1$ and $\mathbf{12}_3$ of the inner group of sensor elements 38 is reduced when there is a bending load on the boom 1 in the bending plane 33 FIG. 4. Sensor element group 38 then displays a different measured signal $U_{si}$ from the outer group of sensor elements 40, given a bending load on the boom 1 in the bending plane 33. The occurrence of a deviation in measured signals $U_{si}$ from sensor element groups 38, 40 is thus an indication of an occurring delamination of the reinforcing layer 7 from the boom hollow profile 2.

FIG. 7 shows another variant of a boom 1. A boom hollow profile of the boom 1 is illustrated in cross section. A reinforcing layer (not illustrated) is provided as a reinforcing lining in the boom hollow profile 2 corresponding to the embodiments discussed above. The boom hollow profile 2 is composed of two profiled sections 4, 5 and has overall an octagonal cross section. Each of the two profiled sections 4, 5 has four kinks in parallel to the longitudinal axis 3.

Reinforcing layer 7 in the described variant can be arranged along the entire boom hollow profile or only along sections thereof.

A boom assembly can be composed of a plurality of such booms 1, which can be inserted one into another in a telescoping manner, for instance, or they can be joined together by articulations.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the present application.

The invention claimed is:

1. A boom (1) for receiving loads on the end thereof comprising:

an inner wall (8) defining a metal boom hollow profile (2) extending along a boom longitudinal axis (3);

a reinforcing layer (7) made of a fiber-plastic composite, disposed within the boom hollow profile (2), present at least in sections;

an electrically insulating intermediate layer coupled between the reinforcing layer and the inner wall (8); and at least one sensor element (12) arranged in the region of the reinforcing layer (7) to detect load forces acting on the boom (1).

2. The boom according to claim 1, wherein the sensor element (12) is designed as a strain sensor.

3. The boom according to claim 1, wherein the sensor element (12) is connected to an external control device (13).

4. The boom according to claim 1, wherein the fiber-plastic composite is constructed with carbon fibers (9).

5. The boom according to claim 4, wherein at least a predominant portion of the fibers (9) of the reinforcing layer (7) is arranged with a component extending parallel to the longitudinal axis (3) of the boom (1).

6. The boom according to claim 4, wherein at least a predominant portion of the fibers (9) of the reinforcing layer (7) is arranged obliquely to the longitudinal axis (3) of the boom (1), wherein different and intersecting fiber orientations are present.

7. The boom according to claim 1, wherein the boom hollow profile (2) is constructed from at least two profiled sections (4, 5) connected together along the boom longitudinal axis (3).

8. The boom according to claim 1, wherein the at least one sensor element (12) comprises a sensor element group (38, 40) with four sensor elements ($\mathbf{12}_1$ to $\mathbf{12}_4$) interconnected as a measuring bridge to detect load forces acting on the boom (1).

9. The boom according to claim 8, wherein at least one of the sensor elements ($\mathbf{12}_1$ to $\mathbf{12}_4$) is arranged on an interior wall (39) of the reinforcing layer (7) and at least one other of the sensor elements ($\mathbf{12}_1$ to $\mathbf{12}_4$) is arranged between the reinforcing layer (7) and the boom hollow profile (2).

10. The boom according to claim 8, wherein the reinforcing layer comprises first and second reinforcing layers connected to respective opposed inner walls of the boom hollow profile, and two of the sensor elements are arranged on the first reinforcing layer and two of the sensor elements are arranged on the second reinforcing layer.

11. The boom according to claim 10, wherein two of the sensor elements are oriented in the longitudinal direction of the boom, and two of the sensor elements are oriented transverse to the longitudinal direction of the boom.

12. The boom according to claim 1, wherein the at least one sensor element comprises a first sensor element group of four sensor elements and a second sensor element group of four sensor elements.

13. The boom according to claim 12, wherein the reinforcing layer comprises first and second reinforcing layers connected to respective opposed inner walls of the boom hollow profile, and the first sensor element group is arranged on the first reinforcing layer and the second sensor element group is arranged on the second reinforcing layer to facilitate detecting delamination of at least one of the first and second reinforcing layers.

14. The boom according to claim 13, wherein at least one sensor element of the first sensor element group is arranged on an interior wall of the first reinforcing layer and at least one other sensor element of the first sensor element group is arranged between the first reinforcing layer and the boom hollow profile, and at least one sensor element of the second sensor element group is arranged on an interior wall of the second reinforcing layer and at least one other sensor element of the second sensor element group is arranged between the second reinforcing layer and the boom hollow profile.

15. A boom (1) for receiving loads on the end thereof comprising:

a metal boom hollow profile (2) extending along a boom longitudinal axis (3);

a reinforcing layer (7) made of a fiber-plastic composite, connected to the boom hollow profile (2), present at least in sections, wherein the reinforcing layer (7) is arranged as a reinforcing lining in a hollow cavity defined by the boom hollow profile (2); and a sensor element group comprising a plurality of strain gauges interconnected as a measuring bridge, the sensor element group arranged on the reinforcing layer.

16. A method for manufacturing a boom (1) according to claim 7 comprising:

preparation of the profiled sections (4, 5) of the boom hollow profile (2);

application of the reinforcing layer (7) onto the boom hollow profile (2) or onto the profiled section (4, 5); and joining the profiled sections (4, 5).

17. The method according to claim 16, wherein the application of the reinforcing layer (7) occurs as follows:

placement of a fiber layer (10) into the boom hollow profile (2) or onto the profiled sections (4, 5) thereof;

injection of a synthetic polymeric resin/hardener mixture into the fiber layer (10); and hardening of the synthetic polymeric resin/hardener mixture.

18. The method according to claim 17, wherein after the placement or during the placement, the fibers (9) of the fiber layer (10) are oriented.

19. The method according to claim 17, wherein the application of the reinforcing layer further comprises:

placement of a tear-off layer onto the fabric layer; and placement of a distribution layer onto the tear-off layer.

20. The method according to claim 16, wherein an intermediate layer (14) is installed between the fiber layer (10) and the boom hollow profile (2) or between the profiled sections (4, 5) thereof.

21. The method according to claim 20, wherein the reinforcing layer (7) is pressed against the boom hollow profile (2) or the profiled section (4, 5) when cemented thereon.

22. The method according to claim 21, wherein two reinforcing layers (7) are cemented simultaneously into the boom hollow profile (2), wherein a pressure element (32) is arranged between the two reinforcing layers (7).

23. The method according to claim 22, wherein the pressure element (32) is filled with a fluid during a pressing of the reinforcing layers (7).

24. A boom for receiving loads on the end thereof, the boom comprising:

a metal boom hollow profile comprising a plurality of inner walls and extending along a boom longitudinal axis;

a reinforcing layer made of fiber-plastic composite and connected to at least one of the inner walls of the boom; and at least one sensor element arranged on the reinforcing layer to detect load forces acting on the boom.

* * * * *